US005567205A

United States Patent [19]

Counts et al.

[11] Patent Number: 5,567,205

[45] Date of Patent: Oct. 22, 1996

[54] WET TREATMENT OF LEATHER HIDES

[75] Inventors: Michael W. Counts, Ambler, Pa.; John A. Thompson, Milwaukee, Wis.; Jack O. Lavoie, Epping, N.H.; Robert A. Aleksejczyk, Newtown, Pa.

[73] Assignee: Henkel Corp., Plymouth Meeting, Pa.

[21] Appl. No.: 470,730

[22] Filed: Jun. 6, 1995

Related U.S. Application Data

[62] Division of Ser. No. 150,508, Nov. 10, 1993, Pat. No. 5,503,754.

[51] Int. Cl.[6] ..... C14C 1/06; C14C 1/08; C14C 3/00; C14C 11/00

[52] U.S. Cl. ..... 8/94.18; 8/94.15; 8/94.21; 8/94.22; 8/94.23; 8/94.26; 8/94.33; 8/436; 8/404; 8/437; 8/637.1; 427/389

[58] Field of Search ..... 8/94.19 R, 94.21, 8/94.22, 94.23, 94.18, 94.15, 94.33, 94.26, 94.27, 94.1 D, 404, 436, 437, 637.1; 252/8.57, 174.17; 427/389, 384; 69/21, 21.5, 22

[56] References Cited

U.S. PATENT DOCUMENTS

| | | | |
|---|---|---|---|
| 5,176,750 | 1/1993 | Kammer et al. | 106/496 |
| 5,266,690 | 11/1993 | McCurry, Jr. et al. | 536/18.6 |
| 5,306,435 | 4/1994 | Ishikawa et al. | 252/8.57 |
| 5,503,754 | 4/1996 | Counts et al. | 252/8.57 |

*Primary Examiner*—Prince Willis, Jr.
*Assistant Examiner*—Alan D. Diamond
*Attorney, Agent, or Firm*—Ernest G. Szoke; Wayne C. Jaeschke; Real J. Grandmaison

[57] ABSTRACT

Wet leather treating compositions and methods of wet treating leather hides employing alkylpolyglycosides for enhancing the penetration and absorption of the leather treatment formulations in an environmentally safe manner. The compositions are substantially free of volatile organic compounds.

6 Claims, 3 Drawing Sheets

WET TREATMENT OF LEATHER HIDES

FIELD OF THE INVENTION

This is a divisional application of Ser. No. 08/150,508 filed on Nov. 10, 1993, now U.S. Pat. No. 5,503,754.

The present invention generally relates to non-toxic leather hide treating compositions and to a method for treating leather hides in an ecologically safe manner. More particularly, environmentally safe alkylpolyglycosides are used in leather treating formulations in place of toxic solvents and surfactants.

BACKGROUND OF THE INVENTION

Despite efforts to replace leather with synthetic leather-like substitutes made from other fibers, sheet materials, and petrochemicals, leather still is the product of choice by consumers. Leather has unique properties that make it ideally suited for use in a variety of products. One of the most important properties of leather is its ability to conform with respect to shape. Plastic flow imparts the necessary give in articles of manufacture, while elastic flow ensures the proper recovery after the flexing action. Leather substitutes fail to achieve the combination of these properties, nor are they able to remove moisture from the surface in which they are in contact. The mechanism of water vapor transmission has been shown to be a function of the material rather than a linear diffusion process.

The leather forming process includes a number of steps before the leather is ready for use in the manufacture of products. Fresh cattlehides are first rehydrated to restore some lost moisture, after which they undergo a process commonly referred to as unhairing or cleaning and degreasing, whose object is the removal of hair, epidermis and certain soluble proteins. This is accomplished by contacting the hides in baths containing caustics, electrolytes, and other components typically employed in the industry. The chemicals used in this process serve three functions: to destroy the hair or attack the hair root so that it comes free from the hide; to loosen the epidermis, which is a hard outer layer covering the grain; and to remove certain soluble skin proteins that lie within the hide substance. The hides then undergo a number of mechanical processes which further remove undesirable parts of the hide. Residual unhairing chemicals, such as hydrated lime for example, and other non-leather making substances are further removed by a process known as bating. Bating chemicals typically come in contact with the hides in various types of vessels to accomplish this procedure. The next major process involved in the treating of leather hides is known as tanning, which stabilizes the collagen fibers present in the hides. There are two types of tanning processes, chrome and vegetable tanning. Prior to engaging in either process, the unhaired hides are acidified with sulfuric acid to lower their pH to less than 3. According to the chrome tanning process, the acidified hides are dipped in an aqueous solution of chromium sulfate until the solution has fully penetrated the hide and its pH has been raised. Once this step is completed, the collagen has been fully reacted and the hide preserved.

Vegetable tanning involves the same preparatory steps as that of chrome tanning except that here, the hides are soaked for a number of days in pits containing solutions of water-soluble extracts of various parts of plant materials, including leaves, fruits, pods, and roots. Vegetable tanning, unlike that of chromium, produces a fullness and resiliency characteristic of only this type of tannage. It provides improved molding characteristics and a hydrophilic character for enhanced removal of perspiration if worn against human skin. The tanned hides are then cleaned of their tannins, placed under pressure to pack the fibers of the leather, and aged.

After the hides are subjected to further preparatory mechanical processes, the remaining wet steps include retanning, coloring, and fatliquoring. Retanning is a wet process which imparts special end-use properties with other tanning chemicals. Chemicals such as vegetable extracts are used for adding solidity and body to the leather, syntans for levelling the color imparted to the leather, and mineral retanning agents for imparting softness to the leather. Coloring with aniline-derived, water-soluble dyes for aesthetic purposes is the next step. Fatliquoring is a process by which the fibers of the leather hide are lubricated in order to impart flexibility and softness to the leather. The leather is then dried, at which point it may be used as is for some applications. In general, however, drying renders the leather too hard and unworkable for most article manufacturing processes so that it must be conditioned. Conditioning or rehydrating involves the introduction of controlled amounts of moisture back into the leather. The final stage of leather treating involves the finishing process. It is the finishing process with its application of natural or synthetic polymers and colorants both within and on the surface of the leather that produces the uniformity, appearance characteristics, and resistance to scuffing and abrasion that are required for a commercial product.

The satisfactory application of the various wetting processes requires that a surfactant and/or a solvent be used as a component of the particular type of composition being employed. The surfactant and/or solvent acts to ensure that the particular composition to which it is added is evenly and effectively distributed throughout the leather. In other words, it aids in the penetration and absorption of the composition into the leather hides. Due to the volatile organic nature of both the solvents and surfactants used in the wet leather treating steps, the EPA has adopted strict guidelines regarding their use and disposal. Compositions which contain such solvents and surfactants are sometimes referred to as volatile organic compound (VOC) compositions. As a result, any solution containing such compositions is potentially dangerous to both its users and the environment. Leather treating solutions and processes which provide for the full or even partial replacement of these harmful components in compositions by more ecologically compatible or friendly components which perform the same function without detracting from the effectiveness of the particular process being employed are highly desirable.

Therefore, there is a need to provide a composition and process for treating leather hides containing a substantially VOC-free surfactant and/or solvent component, as well as a process for effectively treating leather hides in an environmentally friendly manner.

The present invention provides a composition and process for the rehydrating, cleaning and degreasing, and finishing processes of leather.

SUMMARY OF THE INVENTION

Other than in the operating examples, or where otherwise indicated, all numbers expressing quantities of ingredients or reaction conditions used herein are to be understood as modified in all instances by the term "about".

It has now been surprisingly found that by substituting the toxic solvents and surfactants typically employed in wet leather treating solutions with alkylpolyglycosides, comparable or better leather treating solutions can be obtained. Alkylpolyglycosides, a new class of biodegradable nonionic surfactants, have been found to meet or exceed the requirements of solvents and surfactants typically used in leather treating compositions. Alkylpolyglycosides have excellent aqueous solubility and are stable in the presence of high levels of caustics and electrolytes. In addition, they are non-gelling and insensitive to temperature changes. Due to their excellent solubility properties, they effectively replace harmful toxic solvents. Alkylpolyglycosides also exhibit exceptional physical properties such as wetting, moderate foaming, and low interfacial and surface tensions. As a result, these surfactants clearly possess the necessary active properties to replace the use of toxic solvents and surfactants in the leather industry.

In accordance with this invention, it has been found that leather hides can be treated with various types of leather treatment mixtures which are substantially free of volatile organic compounds (VOC) by substituting alkylpolyglycosides for volatile organic solvents and surfactants typically present in these types of mixtures. The present invention provides a VOC-free leather hide wet treating composition, the composition comprising:

(a) a leather hide treating mixture free of volatile organic compounds, (b) water, and (c) an alkylpolyglycoside of formula I $$R^1O(Z)_z \quad (I)$$

wherein $R^1$ is a monovalent organic radical having from about 6 to about 30 carbon atoms, Z is a saccharide residue having 5 or 6 carbon atoms, and a is a number having a value from 1 to about 6.

Preferably, the composition comprises: (a) from about 1 to about 20% by weight of at least one leather hide treating mixture, (b) from about 40 to about 90% by weight water, and (c) from about 1 to about 20% by weight alkylpolyglycoside, wherein the percentages by weight are based on the total weight of the leather hide treating composition.

The present invention also provides a process of wet treating leather hides in an ecologically safe manner comprising contacting the leather hides with a VOC-free leather hide treating composition comprising: (a) a leather hide treating mixture free of volatile organic compounds, (b) water, and (c) an alkylpolyglycoside of formula I as disclosed supra.

There is also provided a leather hide rehydrating composition comprising:

(a) water, and (b) an alkylpolyglycoside of formula I.

Preferably, the composition comprises: (a) from about 70 to about 90% by weight water, and (b) from about 10 to about 30% by weight alkylpolyglycoside, wherein the percentages by weight are based on the weight of the rehydrating composition.

A process of rehydrating leather hides is also provided comprising contacting the leather hides with a VOC-free leather hide rehydrating composition comprising: (a) a leather hide rehydrating mixture free of volatile organic compounds, (b) water, and (c) an alkylpolyglycoside of formula I.

The present invention also provides a leather hide unhairing and cleaning composition free of volatile organic compounds comprising:

(a) leather hide cleaning mixture free of volatile organic compounds, (b) water, and (c) an alkylpolyglycoside of formula I.

Preferably, the composition comprises: (a) from about 10 to about 50% by weight cleaning mixture, (b) from about 20% to about 80% by weight water, and (c) from about 1 to about 20% by weight alkylpolyglycoside of formula I, wherein the percentages by weight are based on the weight of the unhairing and cleaning composition.

A process is also provided for unhairing and cleaning leather hides comprising contacting the hides with a VOC-free leather hide unhairing and cleaning composition comprising: (a) a cleaning mixture free of volatile organic compounds, (b) water, and (c) an alkylpolyglycoside of formula I.

A composition for finishing a leather hide is also provided comprising:

(a) a leather finishing mixture free of volatile organic compounds, (b) water, and (c) an alkylpolyglycoside of formula I.

Preferably, the composition comprises from about 20 to about 60% by weight VOC-free leather finishing mixture, from about 20 to about 60% by weight water, and from about 1 to about 35% by weight alkylpolyglycoside, wherein the percentages by weight are based on the weight of the finishing composition.

Finally, there is also provided a process for finishing leather hides comprising contacting the hides with a VOC-free leather finishing composition comprising: (a) a leather finishing mixture free of volatile organic compounds, (b) water, and (c) an alkylpolyglycoside of formula I.

Various methods can be employed to wet treat, color and finish leather. For example, the dyeing of leather may be accomplished in a tanning drum, so-called drum-dyeing, or by passing the leather through a dip trough, or by applying a stain or dye coat on the surface of the leather. In many cases a stain coat is applied to dyed leather to alter the shade or intensify the color. The stain coat is commonly applied by spray application. A typical prior art stain coat composition contains water, a solvent such as 2-butoxyethanol, and a dye solution. Likewise, the finishing of leather involves applying various coatings and/or dressings to a leather surface. A typical finishing sequence includes applying a stain coat, base coat, intermediate coat, and a top coat. All of these coating compositions and processes typically involve a solvent to promote penetration and adhesion. An example of a typical base coat composition is one containing water, an acrylic polymer emulsion, and a volatile organic compound containing solvent applied by a curtain coater, roll coater or spray applicator.

However, the alkylpolyglycoside based compositions of this invention are designed to replace the volatile organic compound containing compositions of the prior art in all of the afore-mentioned leather treatment processes. In addition, the alkylpolyglycoside based compositions of this invention may contain a pine oil or a terpene to enhance cleaning or degreasing of leather, and also a preservative or a defoaming agent such as a silicone defoamer or a non-silicone defoamer where deemed desirable or necessary.

DETAILED DESCRIPTION OF THE INVENTION

Figure 1:
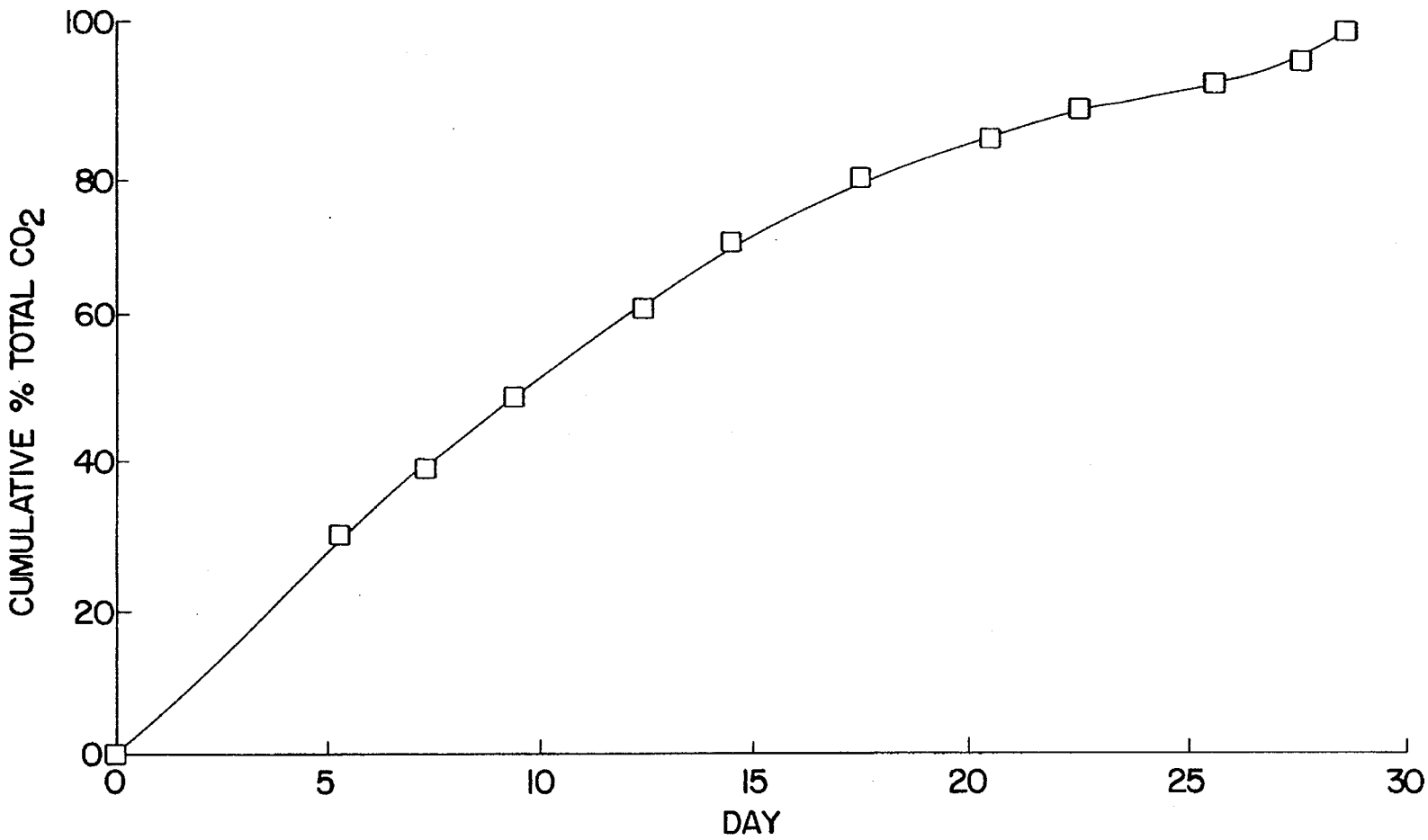
FIG. 1 is a graph illustrating the biodegradability of alkylpolyglycoside by measuring cumulative carbon dioxide formation (%) versus time (days) in accordance with the modified Sturm Test published in Journal of AOCS, 50 (1973), 159. In this test, a substance is deemed readily biodegradable if 60% of its theoretical $CO_2$ has been evolved within 28 days.

It is desirable to treat leather in an ecologically safe manner by employing wet leather treating formulations that are substantially free of volatile organic compounds (VOC).

It has now been found that by substituting alkylpolyglycosides for the conventional solvents and surfactants containing VOC, equally effective, yet ecologically safe wet leather treating processes can be employed.

The alkylpolyglycosides which can be used in the compositions according to the invention have the formula I $$R^1O(Z)_a \quad (I)$$

wherein $R^1$ is a monovalent organic radical having from about 6 to about 30 carbon atoms; Z is saccharide residue having 5 or 6 carbon atoms; and a is a number having a value from about 1 to about 6. The alkyl polyglycosides which can be used in the compositions according to the invention are commercially available, for example, as APG®, Glucopon™, or Plantaren™ surfactants from Henkel Corporation, Ambler, PA., 19002. Examples of such surfactants include but are not limited to:

an alkyl polyglycoside in which the alkyl group contains 8 to 10 carbon atoms and has an average degree of polymerization of about 1.4–1.7;

an alkyl polyglycoside in which the alkyl group contains 9–11 carbon atoms and has an average degree of polymerization of about 1.6;

an alkyl polyglycoside in which the alkyl group contains 8 to 16 carbon atoms and has an average degree of polymerization of about 1.4 to about 1.6; and an alkyl polyglycoside in which the alkyl groups contains 12 to 16 carbon atoms and has an average degree of polymerization of about 1.4 to about 1.6.

Other examples include alkyl polyglycoside surfactant compositions which are comprised of mixtures of compounds of formula I wherein Z represents a moiety derived from a reducing saccharide containing 5 or 6 carbon atoms; a is a number from 1.8 to 3; and $R^1$ is an alkyl radical having from 8 to 20 carbon atoms. The composition is characterized in that it has increased surfactant properties and a hydrophilic-lipophilic balance (HLB)in the range of about 10 to about 16 and a non-Flory distribution of glycosides, which is comprised of a mixture of alkyl monoglycosides and a mixture of alkyl polyglycosides having varying degrees of polymerization of 2 and higher in progressively decreasing amounts, in which the amount by weight of polyglycosides having a degree of polymerization of 2, or mixtures thereof with the polyglycosides having a degree of polymerization of 3, predominate in relation to the amount of monoglycosides, said composition having an average degree of polymerization of about 1.8 to about 3. Such compositions, also known as peaked alkyl polyglycosides, can be prepared by separation of the monoglycosides from the original reaction mixture of alkyl monoglycosides and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in copending application Ser. No. 07/810,588, filed on Dec. 19, 1991, the entire contents of which is incorporated herein by reference.

Freshly skinned hides are typically cured to prevent their putrefaction prior to processing. This curing step tends to remove moisture from the hides, causing them to become hard and difficult to work with. As a result, the first wet process to which the present invention is directed to is the soaking or rehydrating of leather hides. The moisture in the hides must be restored so that the chemical treatments which follow can fulfill their objectives.

The rehydrating composition used in the present invention is comprised of water, alkylpolyglycoside such as of formula I, and disinfectants. Water and the disinfectants are caused to penetrate and be absorbed into the leather by the alkylpolyglycoside present in the composition. The alkylpolyglycoside can be supplied at about 30 to about 70% active ingredient level. The rehydrating composition may include from about 50 to about 95% by weight water, from about 0.1 to about 1.0% by weight disinfectant, and from about 1 to about 30% by weight alkylpolyglycoside.

In a preferred embodiment, the alkylpolyglycoside employed in the rehydrating composition has an alkyl group containing 8 to 16 carbon atoms and a degree of polymerization of from about 1.4 to about 1.7, wherein 10% by weight alkylpolyglycoside, 89.5% by weight water, and 0.5% by weight disinfectant are present in the composition, the percentages by weight being based on the weight of the rehydrating composition. Typical disinfectants which may be employed in the composition include Amical® or Busan® disinfectants. Additional additives such as enzymes may also be employed to further prepare the leather for the wet treatments yet to follow. The pH of the composition is preferably from about 7 to about 14 . In addition, a silicone or non-silicone defoamer may be present.

According to a process aspect of the invention, leather hides are rehydrated by contacting the hides with the rehydrating composition. The contacting is performed by soaking the hides in a vessel containing the above-described composition. Typical vessels which may be employed include tanning drums, hide mixers, and paddle vats. These vessels contain some type of agitating means whereby the hides soaking in the vessel are agitated so that they flex and gradually absorb water. Depending on the thickness of the hides, they are typically soaked in these vessels for about 8 to about 20 hours, after which they become softer and cleaner. After the rehydrating or soaking process, the hides are then rinsed with fresh water so as to remove excess salt, dirt, and blood from the hides. A pH from about 5 to about 9, and preferably about 6 to about 8 should be maintained during the process.

In another aspect of this invention, an unhairing and cleaning composition is provided which removes hair, fat, oils, epidermis and certain other soluble proteins. The unhairing and cleaning composition employed here includes an alkaline mixture, water, and an alkylpolyglycoside. The alkaline mixture most commonly employed comprises calcium hydroxide, i.e., hydrated lime, and sodium sulfide. The chemicals employed in the alkaline mixture must destroy the hair or attack the hair root so that the hair will come free, loosen the epidermis, and remove certain soluble skin proteins. While the above mentioned components are those typically found in the unhairing and cleaning composition, other additives such as enzymes may also be used. Also, various types of electrolytes, primarily in the form of salts, and other left-over chemicals from previous processes may be also present in the composition once the hides are treated.

The alkylpolyglycoside employed in the unhairing and cleaning composition is the same as that of formula I. The composition typically comprises from about 10 to about 70% by weight alkaline mixture, from about 20 to about 80% by weight water, and from about I to about 20% by weight alkylpolyglycoside. With respect to the alkaline mixture in particular, it comprises from about 40 to about 60% calcium hydroxide and from about 40 to about 60% by weight sodium sulfide, the percentages being based on the weight of the alkaline mixture. It should be noted, however, that any similar types of alkaline mixtures may also be employed for the intended purpose, without departing from the spirit of the invention.

In a preferred embodiment, the composition includes an alkylpolyglycoside having an alkyl group containing 8 to 16 carbon atoms and a degree of polymerization of about 1.4 to about 1.7, and wherein 5% by weight of the alkylpolyglycoside, 35% by weight of the alkaline mixture, and 60% by weight water are present in the composition. The weights are based on the weight of the unhairing and cleaning composition. The pH of the composition is from about 10 to about 14, and preferably 13.

According to a process aspect of the invention, leather hides are unhaired and cleaned by contacting the hides with the above-described unhairing and cleaning composition. The contacting step is performed by depositing the unhairing and cleaning composition into an agitated vessel which typically already contains the hides to be unhaired and cleaned. This is because the unhairing and cleaning process is usually performed immediately following the soaking or rehydrating process so that the same vessel is used while the hides are still in it. The concentration of the unhairing and cleaning composition, the water temperature, and the amount of agitation in the vessel, all have a direct bearing on the rate at which the unhairing proceeds. For example, higher concentrations and temperatures can result in hair being dissolved in a few hours. Conversely, if it is desirable to save the hair for other uses, a weaker concentration of unhairing composition or lower temperature should be employed, which results in the removal process taking longer. A pH of about 12 to about 14, and preferably about 13 should be maintained during the process.

The next wet leather treatment process is known as bating. This process is used to remove any residual unhairing and cleaning composition present on the leather. Bating is performed in two phases: deliming, and actual bating.

In the actual bating process, a bating composition is employed comprising salt, water, and an alkylpolyglycoside of formula I. In general, ammonium sulfate and ammonium chloride salts can be used in the bating process. These salts are added to neutralize or convert residual lime into soluble compounds which can be washed free. The amounts of components which may be included in the bating composition include from about 30 to about 50% by weight of said salt, from about 1 to about 10% by weight water, and from about 30 to about 50% by weight of alkylpolyglycoside.

In a preferred embodiment, about 45% by weight said salt, about 5% by weight water, and about 50% by weight alkylpolyglycoside having an alkyl group containing 8 to 16 carbon atoms and a degree of polymerization of about 1.4 to about 1.7, is present in the bating composition. The weights are based on the weight of the bating composition. The composition may also include other additives such as enzymes, which aid in speeding up the bating process. The pH of the composition may range from about 6 to about 10, and is preferably about 8.5.

According to a process aspect of the invention, fresh water is introduced into the vessel containing the unhaired hides and then discharged, thereby washing away lime-containing chemicals present on the hides and in the vessel. The washed hides are then contacted with the above bating composition. The contacting step involves the introduction of the bating composition into the vessel containing the hides, after which they are soaked for about 1 to about 4 hours, depending on the concentration, temperature, and additives used in the bating composition. The hides are then washed again with fresh water introduced into the vessel which is then discharged, along with the undesirable products. A pH from about 6 to about 8.5, and preferably about 8 should be maintained during the process.

The next aspect of this invention involves the tanning of the leather hides. A tanning composition comprising a tanning agent, water, and an alkylpolyglycoside is prepared. The tanning agent can be one typically used in the industry such as sodium bichromate reacted with a sugar-like substance such as glucose plus sulfuric acid. The composition includes from about 1 to about 3% by weight tanning agent, from about 85% to about 95% by weight water, from about 4 to about 8% by weight brine, and from about I to about 5% by weight of an alkylpolyglycoside of formula I. The tanning composition may also include additional additives to help enhance the tanning process.

In a preferred embodiment, the tanning composition comprises about 1.5% by weight tanning agent, about 90.5% by weight water, about 6% by weight brine, and about 2% by weight alkylpolyglycoside having an alkyl group containing 8 to 16 carbon atoms and a degree of polymerization of about 1.4 to about 1.7. The tanning agent preferably includes 30% by weight sodium bichromate, reacted with 1% by weight glucose, and 39% by weight sulfuric acid, and 30% by weight water. The weights are based on the weight of the tanning composition. The pH of the tanning composition is from about 1 to about 3, and preferably about 2.

According to a process aspect of the invention, leather hides are tanned by contacting the hides with the above-described tanning composition. The contacting step is performed by placing the hides in a tanning vessel or drum, typically one which rotates, and then introducing the above-described tanning composition into the drum. However, it should be noted that prior to introducing the composition into the drum, the components of the tanning composition must first be thoroughly mixed in a mixing tank. As the tanning composition penetrates the leather hide, the pH conditions within the tanning drum are slowly raised to increase the fixation of chrome with the skin protein. This is accomplished by adding a mildly alkaline substance such as baking soda, which reduces the acidity and increases the affinity of the protein for the chrome.

In another aspect of the invention, there is provided a retanning composition for imparting special end-use properties with other tanning chemicals. The retanning composition includes a retanning agent, water, and an alkylpolyglycoside of formula I. The retanning agent may be vegetable extracts which add solidity and body to the leather hides, syntans used for shading the hides, and mineral retanning agents for imparting softness to the hides, or combinations thereof. The proportions of these components may include from about 20 to about 40% by weight retanning agent, from about 40 to about 80% by weight water, and from about 1 to about 5% by weight alkylpolyglycoside. Additional retanning additives may also be added to help enhance the process.

In a preferred embodiment, the retanning composition comprises about 25 to 32% by weight tanning agents, about 62 to 72% by weight water, and about 3% by weight alkylpolyglycoside having an alkyl group containing 8 to 16 carbon atoms and a degree of polymerization of about 1.4 to about 1.7. The weights are based on the weight of the retanning composition. The pH of the composition is from about 4 to about 5, and preferably about 4.5.

According to a process aspect of the invention, leather hides are retanned by contacting the hides with the above-described retanning composition. The contacting step is performed by depositing the retanning composition into a vessel containing the hides, preferably a vessel which revolves, and agitating it therein for about 1 to about 2 hours. Both the temperature and pH of the system must be maintained at a certain level, typically from about 90° F. to about 120° F. In order for this process to be most effective. A pH of preferably about 4 to about 5 should be maintained during the process. Also, a temperature from preferably about 90° F. to about 120° F. should similarly be maintained during the process.

Another aspect of this invention provides for coloring leather hides with a coloring composition comprising a coloring agent, water, and an alkylpolyglycoside of formula I. The coloring agent may be any typically employed aniline derived, water-soluble dye. The components of the coloring composition that are present include from about 5 to about 20% by weight coloring agent, from about 20 to about 90% by weight water, and from about 1 to about 5% by weight alkylpolyglycoside of formula I. The weights are based on the weight of the coloring composition.

In a preferred embodiment, the composition includes about 10% by weight aniline dye selected from the group consisting of acid dyes, metallized dyes, direct dyes, basic dyes, and combinations thereof, about 85% by weight water, and about 5% by weight alkylpolyglycoside having an alkyl group containing 8 to 16 carbon atoms and an average degree of polymerization of about 1.4 to about 1.7 weights are based on the weight of the coloring composition. The pH of the composition is from about 4.5 to about 6, and preferably about 4.5 to about 5.

According to a process aspect of the invention, leather hides are colored by contacting the hides with a coloring composition in accordance with the present invention. This is done by depositing the coloring solution into a vessel containing the hides for a predetermined amount of time. The affinity of the dyes for the leather fibers is regulated by controlling the pH of the system, which may vary between 4 to 6, depending on what type of dye(s) is used and the effect desired.

Another aspect of the invention provides for the fatliquoring of leather hides in order to lubricate the fibers for flexibility and softness, using a fatliquoring composition which includes a fatliquor, water, and an alkylpolyglycoside of formula I. The components of the composition include from about 10 to about 30% by weight fatliquors, from about 20 to about 80% by weight water, and from about 1 to about 10% by weight alkylpolyglycoside of formula I. The fatliquors comprise oil and related fatty substances which represent products selected from animal, vegetable, and mineral sources. The alkylpolyglycoside causes an emulsion to be formed between the fatliquors and water, as well as enhancing the absorption and penetration of the fatliquoring composition.

In a preferred embodiment, the fatliquoring composition comprises about 20% by weight fatliquors, about 74% by weight water, and about 6% by weight of an alkylpolyglycoside having an alkyl group containing from 8 to 16 carbon atoms and a degree of polymerization of about 1.4 to about 1.7. Additional additives typically employed in the industry may also be present in the fatliquoring composition. The weights are based on the weight of the fatliquoring composition. The composition preferably has a pH from about 6 to about 8.

According to a process aspect of the invention, a leather hide is fatliquored by contacting the hide with the above-described fatliquoring composition. The contacting step involves depositing the fatliquoring composition into a vessel containing the hides, and agitating the hides within the vessel for about one hour. A pH of about 4 to about 5.5, should preferably be maintained during the process.

Another aspect of the invention, similar to rehydrating, is commonly referred to as conditioning or wetting back a leather hide. If the leather hides require more softness or temper, they must be conditioned. A conditioning composition is provided comprising water and an alkylpolyglycoside of formula I.

In one embodiment thereof, the composition includes from about 70 to about 99% by weight water, and from about 0.2 to about 10% by weight alkylpolyglycoside. In a preferred embodiment the composition contains about 98% by weight water, and about 2% by weight of an alkylpolyglycoside having from 8 to 16 carbon atoms and a degree of polymerization of about 1.4 to about 1.7. The weights are based on the weight of the conditioning composition. Additional additives typically employed in the industry may also be employed without departing from the spirit of the invention. The pH of the composition is preferably from about 7 to about 9, and preferably about 8.

According to a process aspect of the invention, the process of conditioning leather comprises contacting the leather hide with the above-described conditioning composition. The contacting step includes applying a fine mist of the conditioning composition onto the surfaces of the hides as they pass spray nozzles along a conveyor belt. The sprayed hides are then stored in a watertight enclosure for such a time until the moisture content is raised to about 25% throughout the hides.

In yet another aspect of the invention there is provided a finishing composition for finishing leather hides. The finishing composition comprises from about 10 to about 70% by weight of a coating or finishing mixture, from about 5 to about 70% by weight water, and from about I to about 30% by weight of an alkylpolyglycoside of formula I.

In many cases it is desirable to color and finish leather. The dying of leather can be done in a tanning drum, or by passing the leather through a dip trough, or by applying a stain (dye) coat on the surface of the leather. In many cases a stain coat is applied to leather that is already dyed to alter the shade or intensify the color. A stain coat is commonly applied by spray application. A typical stain coat composition comprises from about 60 to 80% by weight of water, about 10 to about 20% by weight of dye solutions, and from about 10 to about 20% of an alkylpolyglycoside of formula I. The finishing of leather involves applying various coatings and/or dressings to the surface of the leather. A typical finishing sequence is: stain coat, base coat, intermediate coat(s), top coat. A typical base coat composition comprises from about 30 to about 50% by weight of acrylic polymer emulsion, from about 30 to about 50% by weight of water, and from about 10 to about 30% by weight of an alkylpolyglycoside of formula I.

The coating or finishing mixture may be selected from aniline dyes, pigments, acrylates, vinyl polymers, butadiene polymers, nitrocellulose, and polyurethanes. In a preferred embodiment, the alkylpolyglycoside used in the finishing composition has an alkyl group containing 8 to 16 carbon atoms and an average degree of polymerization of about 1 to about 6. Additional additives may also be employed without departing from the spirit of the invention.

According to a process aspect of the invention, there is provided a process for finishing leather hides comprising contacting the hides with the above-described finishing composition, and then drying the finished leather. The contacting step may be performed using numerous methods. The finishing composition can be pumped into a trough, wherefrom it is picked up by a rotating fluted roll, whereby rotary brushes transfer the finishing composition from the roll and onto the leather, at which time the composition is swabbed into the grain and smoothed out. Coating may also be performed by pouring the finishing composition onto the leather hides by means of a flow coating machine. The composition may also be sprayed onto the hides using a rotary sprayer. The composition may also be roll coated onto the hides whereby it is transferred directly from a rubber coated or knurled steel roll to the leather hide surface. Once the finishing composition has been applied onto the leather hide, they are then dried. The drying step may either include air drying, steam drying, or infra-red heat drying.

In practicing the invention as described above, it is clear that the use of alkylpolyglycosides in place of toxic solvents and surfactants typically used in the industry for enhancing the penetrating and absorbing abilities of the various wet leather treatments is highly desirable. The wetting ability of alkylpolyglycosides on leather were compared to solvents and other surfactants typically employed in leather hide treatment mixtures using the Draves-Clarkson and Contact Angle wetting tests. Based on the results, it was surprisingly found that the alkylpolyglycosides performed as well, and in some instances better, than the conventional solvents and surfactants.

Tables 1 shows a comparison of the physical properties of a $C_9$—$C_{11}$ alkylpolyglycoside having a degree of polymerization of about 1.4 in accordance with the present invention with an ethoxylated nonylphenol containing 9.5 moles ethylene oxide, a surfactant commonly used in the above wet leather processes. The effectiveness of the alkylpolyglycoside as a wetting agent is clearly evident. In Table 1 the alkylpolyglycoside is abbreviated as $C_{9\text{-}11}G_{1.4}$ wherein G represents the degree of polymerization. The ethoxylated phenol is abbreviated as $NPE_{9.5}$. The Draves test wetting data was obtained per ASTM method D 2281-68 at 25° C. and is reported in seconds. The Ross Miles foam test data was obtained per ASTM method D1173-53 at 50° C. and is reported in millimeters. The Interfacial Tension (IFT) test data was obtained by spinning drop method using mineral oil at 25° C. and reported in dynes/cm. The surface tension test data was obtained by Wilhemy Plate Method, is reported in dynes/cm and was obtained at room temperature wherein the test materials were diluted in distilled water.

TABLE 1

| | Draves Wetting | Ross Miles Foam | IFT Mineral Oil | Surface Tension |
|---|---|---|---|---|
| SURFACTANT | 0.1% | 0.1% | 0.1% | 0.1% |
| $C_{9\text{-}11}$–$G_{1.4}$ | 12 | 155 | 1.4 | 28 |
| $NPE_{9.5}$ | 11 | 80 | 3 | 30 |

Table 2 illustrates that alkylpolyglycosides are significantly less toxic than their surfactant counterparts, and hence when used in accordance with the present invention in the wet leather treatment of hides, provides a substantially more environmentally safe way of treating leather.

TABLE 2

| SURFACTANT | Daphnia pulex $LC_{50}$ (48 HR) |
|---|---|
| $C_{9\text{-}11}$–$G_{1.4}$ | 40.0 ppm |
| $NPE_{10}$ | 13.0 ppm |
| $C_{12}LAS$ | 8.6 ppm |

In Table 2, $C_{12}LAS$ represents a linear dodecylbenzene sulfonate surfactant. The aquatic toxicities of the surfactant materials tested were obtained by using the water flea Daphnia Pulex as published by Lewis, M. A. and D. Suprenant in *Ecotoxicology and Environmental Safety*, vol. 7, (1982), 313. The 48 hour $LC_{50}$ value represents the concentration of a chemical in water which kills 50% of the test animals. Therefore, the lower the $LC_{50}$ concentration the more toxic is the substance being tested. It can be seen from Table 2 that the $LC_{50}$ value for the alkylpolyglycoside is 40 ppm which is the highest of the test groups.

DETAILED DESCRIPTION OF THE DRAWINGS

Figure 2:
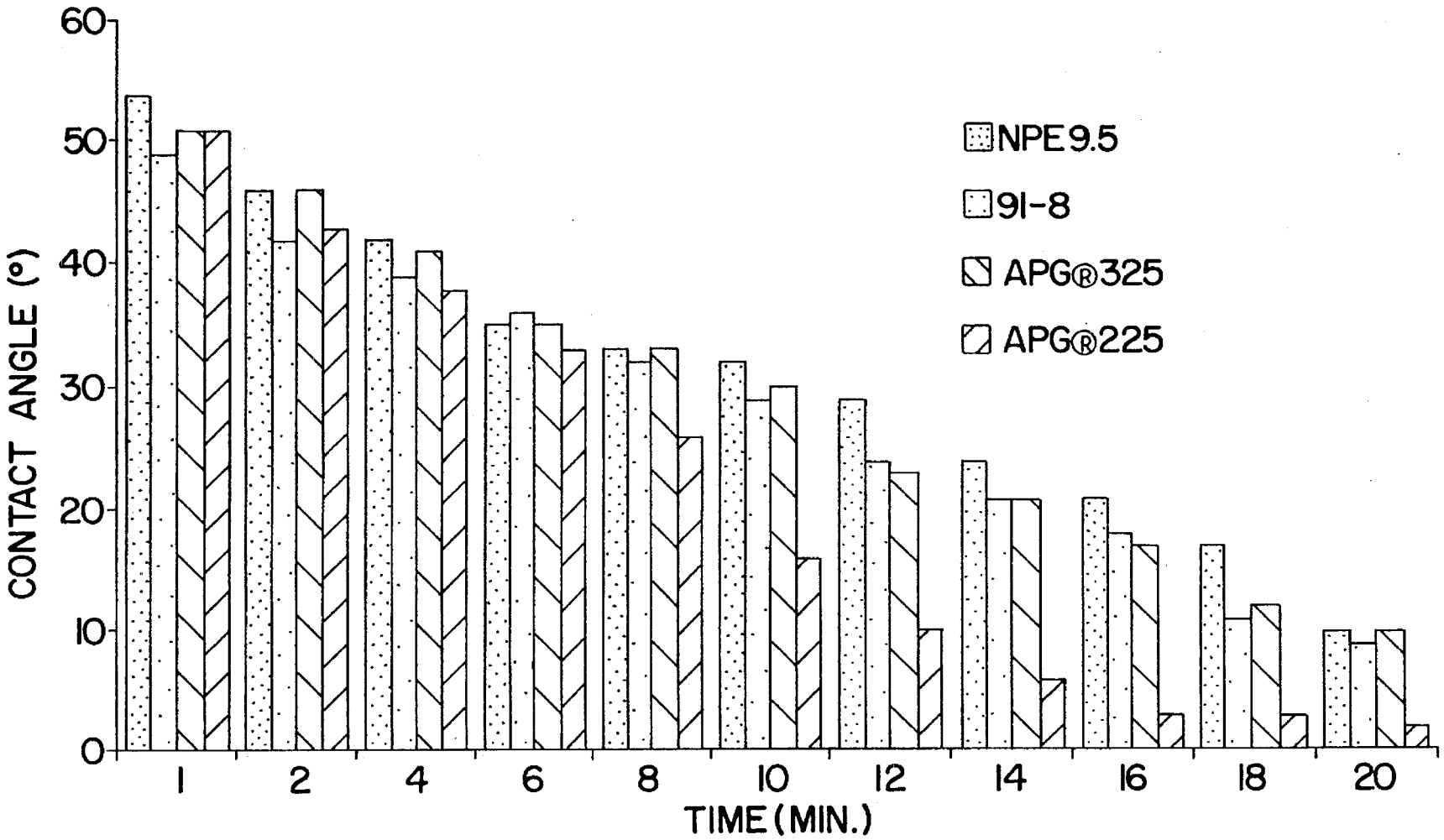
FIG. 2 is a bar graph illustrating the wetting ability of alkylpolyglycosides versus typical leather surfactants at 1% concentration, using a contact angle wetting test.
Figure 3:
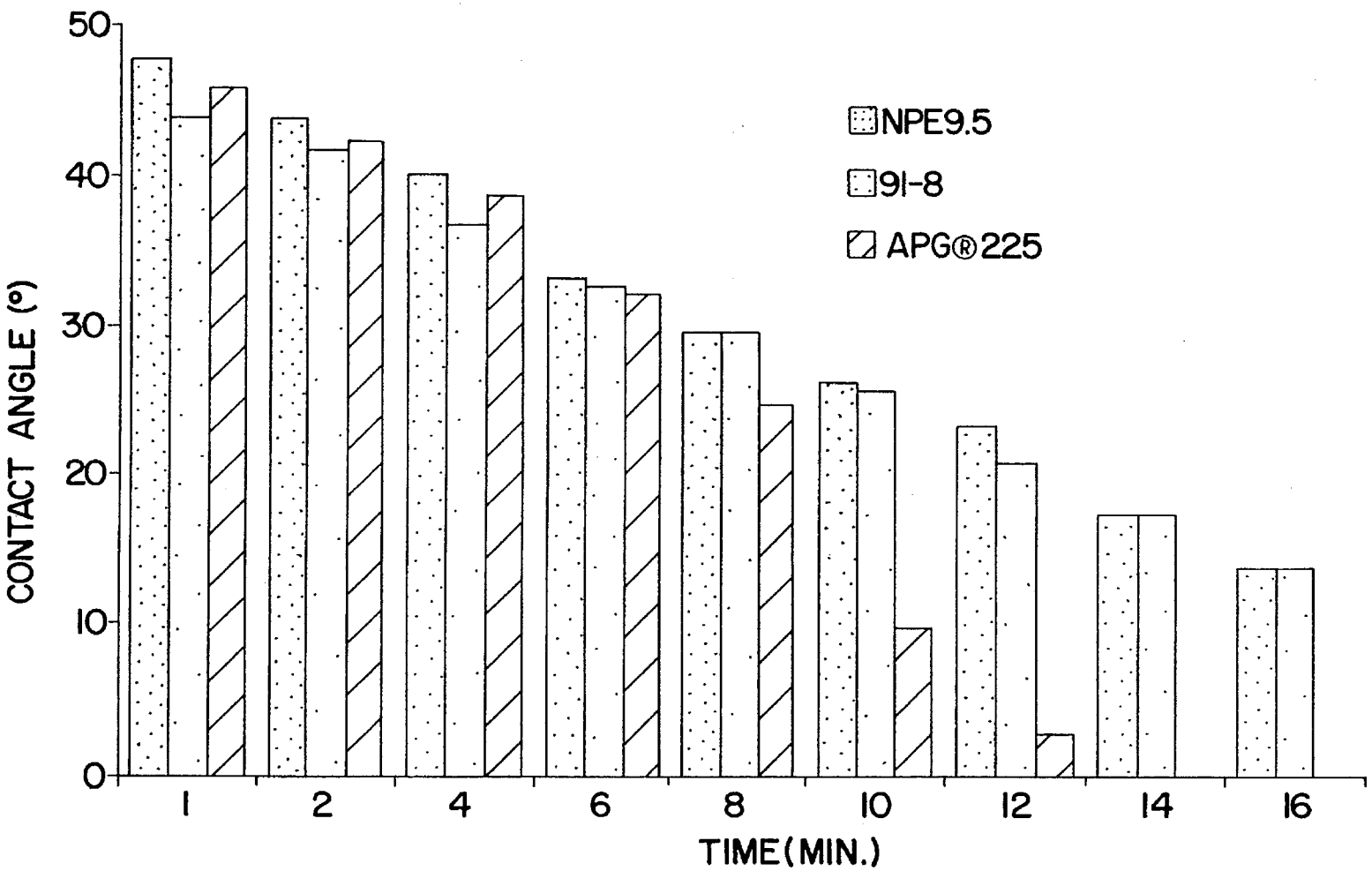
FIG. 3 is a bar graph illustrating the wetting ability of alkylpolyglycosides versus typical leather surfactants at 0.5% concentration, using a contact angle wetting test.

As earlier indicated herein, FIG. 2 and FIG. 3 are bar graphs illustrating the wetting ability of alkylpolyglycosides versus typical leather surfactants at 1% by weight concentration and at 0.5% by weight concentration, respectively, using a contact angle wetting test. In said figures, $NPE_{9.5}$ represents ethoxylated nonyl phenol containing 9.5 moles of ethylene oxide. The designation 91-8 represents a $C_9$—$C_{11}$ linear primary alcohol ethoxylate containing an average of 8 moles ethylene oxide per mole alcohol commercially available as Neodol® 91-8 from Shell Chemical Company. The designation APG® 325 represents an alkyl polyglycoside wherein the alkyl group contains 9 to 11 carbon atoms and has an average degree of polymerization of about 1.6 commercially available from Henkel Corporation, Ambler, PA. The designation of APG® 225 represents an alkyl polyglycoside wherein the alkyl group contains 8 to 10 carbons and has an average degree of polymerization of about 1.7 commercially available from Henkel Corporation, Ambler, Pa.

FIG. 2 and FIG. 3 show the advantage of employing alkylpolyglycosides in the rehydration of Crust Stock leather. It is shown therein that alkyl polyglycosides wets the leather faster than other typically used surfactants for this purpose. The contact angle wetting test is performed by using a Goniometer to measure the angle of contact as a function of time.

Thus, it has been shown that leather treatment compositions free of volatile organic compounds based on alkyl polyglycosides allow improved wetting and penetration of various types of leather treatment compositions without the use of organic solvents. The compositions of this invention may be used in tanneries as an effective and direct replacement for solvents normally used in stain and impregnation coating compositions. The compositions are compatible with most water-miscible base coats, intermediates or top coats, and can be applied where penetration may be a problem.

What is claimed is:

1. A process for unhairing and cleaning leather hides comprising contacting said hides with a formulation which is free of volatile organic compounds and which comprises:

a) a leather hide unhairing and cleaning composition containing an alkaline mixture, b) water, and an alkylpolyglycoside having formula I $$R^1O(Z)_z \quad (I)$$

wherein $R^1$ is a monovalent organic radical having from about 6 to about 30 carbon atoms, Z is a saccharide residue having 5 or 6 carbon atoms, and a is a number having a value from 1 to about 6.

2. The process as in claim 1 wherein said formulation comprises from about 20 to about 80% by weight of water, from about 10 to about 70% by weight of alkaline mixture, and from about 1 to about 20% by weight of said alkylglycoside, based on the weight of the said formulation.

3. A process for bating leather hides comprising contacting said hides with a formulation which is free of volatile organic compounds and which comprises:

a) a leather hide bating composition containing a salt, b) water, and c) an alkylpolyglycoside having formula I $$R^1O(Z)_a \quad (I)$$

wherein $R^1$ is a monovalent organic radical having from about 6 to about 30 carbon atoms, Z is a saccharide residue having 5 or 6 carbon atoms, and a is a number having a value from 1 to about 6.

4. The process as in claim 3 wherein said formulation comprises from about 30 to about 50% by weight of a salt selected from the group consisting of ammonium sulfate and ammonium chloride, from about 1 to about 10% by weight of water, and from about 30 to about 50% by weight of said alkylpolyglycoside, based on the weight of said formulation.

5. A process for fatliquoring leather hides comprising contacting said hides with a formulation which is free of volatile organic compounds and which comprises:

a) a leather hide fatliquoring agent, b) water, and c) an alkylpolyglycoside having formula I $$R^1O(Z)_a \quad (I)$$

wherein $R^1$ is a monovalent organic radical having from about 6 to about 30 carbon atoms, Z is a saccharide residue having 5 or 6 carbon atoms, and a is a number having a value from 1 to about 6.

6. The process as in claim 5 wherein said formulation comprises from about 10 to about 30% by weight of the fatiliquoring agent, from about 20 to about 80% by weight of water, and from about 1 to about 10% by weight of said alkylpolyglycoside, based on the weight of said formulation.

* * * * *